US008032070B2

(12) United States Patent
Suzaki

(10) Patent No.: US 8,032,070 B2
(45) Date of Patent: Oct. 4, 2011

(54) IMAGE FORMING APPARATUS AND DOUBLE-SIDED PRINTING METHOD FOR IMAGE FORMING APPARATUS

(75) Inventor: Yoshikazu Suzaki, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1080 days.

(21) Appl. No.: 11/840,376

(22) Filed: Aug. 17, 2007

(65) Prior Publication Data

US 2009/0047051 A1 Feb. 19, 2009

(51) Int. Cl.
*G03G 15/00* (2006.01)

(52) U.S. Cl. ..... 399/401; 399/320; 399/322

(58) Field of Classification Search ..... 399/401, 399/320, 322

See application file for complete search history.

(56) References Cited

U.S. PATENT DOCUMENTS

2003/0108359 A1* 6/2003 Chung ..... 399/124
2007/0041036 A1 2/2007 Nakayama

FOREIGN PATENT DOCUMENTS

JP 2003-323019 11/2003
JP 2005208401 A * 8/2005

* cited by examiner

*Primary Examiner* — Daniel J Colilla
*Assistant Examiner* — Allister Primo
(74) *Attorney, Agent, or Firm* — Turocy & Watson, LLP

(57) ABSTRACT

To provide an image forming apparatus and a double-sided printing method for the image forming apparatus that can prevent occurrence of an image failure by providing a sheet retracting mechanism in a conveying path of an automatic double-sided printing device and preventing occurrence of temporary stop near a high-temperature fixing device during a double-sided printing operation.

The image forming apparatus includes an image forming unit 1A that forms images on sheets E and F, a fixing device 17 that fixes the images formed by the image forming unit 1A on the sheets E and F, an automatic double-sided printing device 81 that has a conveying path 82 for conveying the sheets E and F having the images fixed thereon by the fixing device 17 into the automatic double-sided printing device 81 and reversing the sheets E and F conveyed into the automatic double-sided printing device 81 to feed the sheets E and F to the image forming unit 1A, and a retracting mechanism 106 that stops the sheets E and F, which is stopped to be conveyed in the conveying path 82, in a position away from the fixing device 17 to retract the sheets E and F from heat of the fixing device 17, the retracting mechanism 106 being provided in the conveying path 82 of the automatic double-sided printing device 81.

14 Claims, 8 Drawing Sheets

IMAGE FORMING APPARATUS AND DOUBLE-SIDED PRINTING METHOD FOR IMAGE FORMING APPARATUS

BACKGROUND OF THE INVENTION

1. Field of the Invention

The present invention relates to an image forming apparatus and the like including an automatic double-sided printing device, and, more particularly to an image forming apparatus including a mechanism for preventing a sheet from being heated by a fixing device to cause an image failure and a double-sided printing method for the image forming apparatus.

2. Description of the Related Art

Conventionally, as image forming apparatuses to which an electrophotographic technique is applied such as a facsimile and a laser printer, there is known an image forming apparatus of a circulation type that forms, in performing double-sided printing, an image on one side of a sheet in an image forming unit in an image forming apparatus main body and, after fixing the image with a fixing device, switches back the sheet with a paper discharge roller, conveys the sheet into an automatic double-sided printing device disposed on a side of the image forming apparatus main body, and reverses the sheet to feed the sheet to the image forming unit again. As such an image forming apparatus of the circulation type, there is known an image forming apparatus of a type that sequentially performs, after single-sided printing of a first sheet, single-sided printing of second and third sheets, simultaneously conveys plural sheets in an automatic double-sided printing device, and sequentially feeds the sheets from the automatic double-sided printing device to an image forming unit in order to improve productivity (see, for example, JP-A-2005-70223).

However, in the techniques described above, the image forming apparatuses have mechanisms in which a sheet is inevitably conveyed near the high-temperature fixing device again after single-sided printing of the sheet. Thus, for example, when processing by a CPU is delayed or supply of a heat quantity to the fixing device is delayed because of a large amount of image information, the sheet may be inevitably stopped near the fixing device during the switchback because of limitation in image processing. As time of this stop is longer, it is more likely that, in particular, a sheet for color printing is deteriorated when the sheet is left untouched in a high-temperature environment and color unevenness (image dust) occurs.

In other words, in double-sided printing in the circulation type performed by using a sheet exclusively used for color printing in the conventional color image forming apparatus, when a sheet being printed is inevitably stopped under the situation described above, an image failure occurs if a part of the sheet is located in a high-temperature portion near the fixing device.

On the other hand, image forming apparatuses in recent years tend to be improved in image quality, reduced in size, increased in speed, and used for color printing. Thus, double-sided printing of the circulation type is essential. Moreover, image processing is complicated and the length of a sheet conveying path is reduced.

Therefore, it is extremely difficult to provide a conveying path such that places where all sheets being conveyed are stopped are away from positions near high-temperature positions heated by the fixing device when a following sheet is temporarily stopped because of, for example, standby for processing of a preceding sheet.

As measures against such an image failure, a method of lowering a fixing temperature to control damage due to heat to a color printing sheet is conceivable. However, lowering of the fixing temperature makes development of toners and development of engine sections of image forming apparatuses inevitable. Therefore, expenses and personal expenses required for the development are enormous.

SUMMARY OF THE INVENTION

The present invention has been devised in order to solve the problem and it is an object of the present invention to provide an image forming apparatus and a double-sided printing method for the image forming apparatus that can prevent occurrence of an image failure by providing a sheet retracting mechanism for stopping a sheet in a conveying path of an automatic double-sided printing device and preventing occurrence of temporary stop near a high-temperature fixing device during a double-sided printing operation.

In order to solve the problems, an image forming apparatus according to an aspect of the present invention includes an image forming unit that forms an image on a sheet, a fixing device that fixes the image formed by the image forming unit on the sheet, an automatic double-sided printing device that has a conveying path for conveying the sheet having the image fixed thereon by the fixing device into the automatic double-sided printing device and reversing the sheet conveyed into the automatic double-sided printing device to feed the sheet to the image forming unit, and a retracting mechanism that stops the sheet, which is stopped to be conveyed in the conveying path, in a position away from the fixing device to retract the sheet from heat of the fixing device, the retracting mechanism being provided in the conveying path of the automatic double-sided printing device.

An image forming apparatus according to another aspect of the present invention includes image forming means for forming an image on a sheet, fixing means for fixing the image formed by the image forming means on the sheet, automatic double-sided printing means that has a conveying path for conveying the sheet having the image fixed thereon by the fixing means into the automatic double-sided printing means and reversing the sheet conveyed into the automatic double-sided printing means to feed the sheet to the image forming means, and retracting means for stopping the sheet, which is stopped to be conveyed in the conveying path, in a position away from the fixing means to retract the sheet from heat of the fixing means, the retracting means being provided in the conveying path of the automatic double-sided printing means.

A double-sided printing method for an image forming apparatus according to still another aspect of the present invention includes conveying, via a fixing device, a following sheet into an automatic double-sided printing device subsequently to a preceding sheet from an image forming unit that forms an image on a sheet, detecting the preceding sheet stopped to be conveyed in a conveying path of the automatic double-sided printing device and, when it is detected that the preceding sheet is stopped to be conveyed, stopping the following sheet in a position away from the fixing device to retract the following sheet from heat of the fixing device.

According to the constitution of the present invention, since the retracting mechanism that stops a sheet in a position away from the fixing device is provided in the conveying path of the automatic double-sided printing device, even if the conveyance of the sheet is stopped by some cause during a double-sided printing operation, it is possible to prevent occurrence of temporary stop of the sheet near the high-temperature fixing device. Consequently, even if the sheet is stopped near the fixing device, since the sheet is retracted to a position away from the fixing device by the retracting mechanism, the sheet is not affected by the high-temperature fixing device and image dust is not formed. Therefore, it is possible to prevent occurrence of an image failure.

According to a reduction in size of the image forming apparatus, even if the length the conveying path of the automatic double-sided printing device is reduced, it is possible to retract the following sheet from position near the fixing device without interfering the preceding sheet with the following sheet by the retracting mechanism. Therefore, since a further reduction in size of the image forming apparatus is facilitated, it is possible to prevent occurrence of an image failure even if sheets of sizes such as A3 and A4 are used.

Since it is unnecessary to lower a fixing temperature of the fixing device in order to prevent formation of image dust due to an influence of the fixing device, it is possible to prevent occurrence of an image failure at low cost.

DESCRIPTION OF THE EMBODIMENTS

Embodiments of the present invention will be explained with reference to the drawings.

Figure 1:
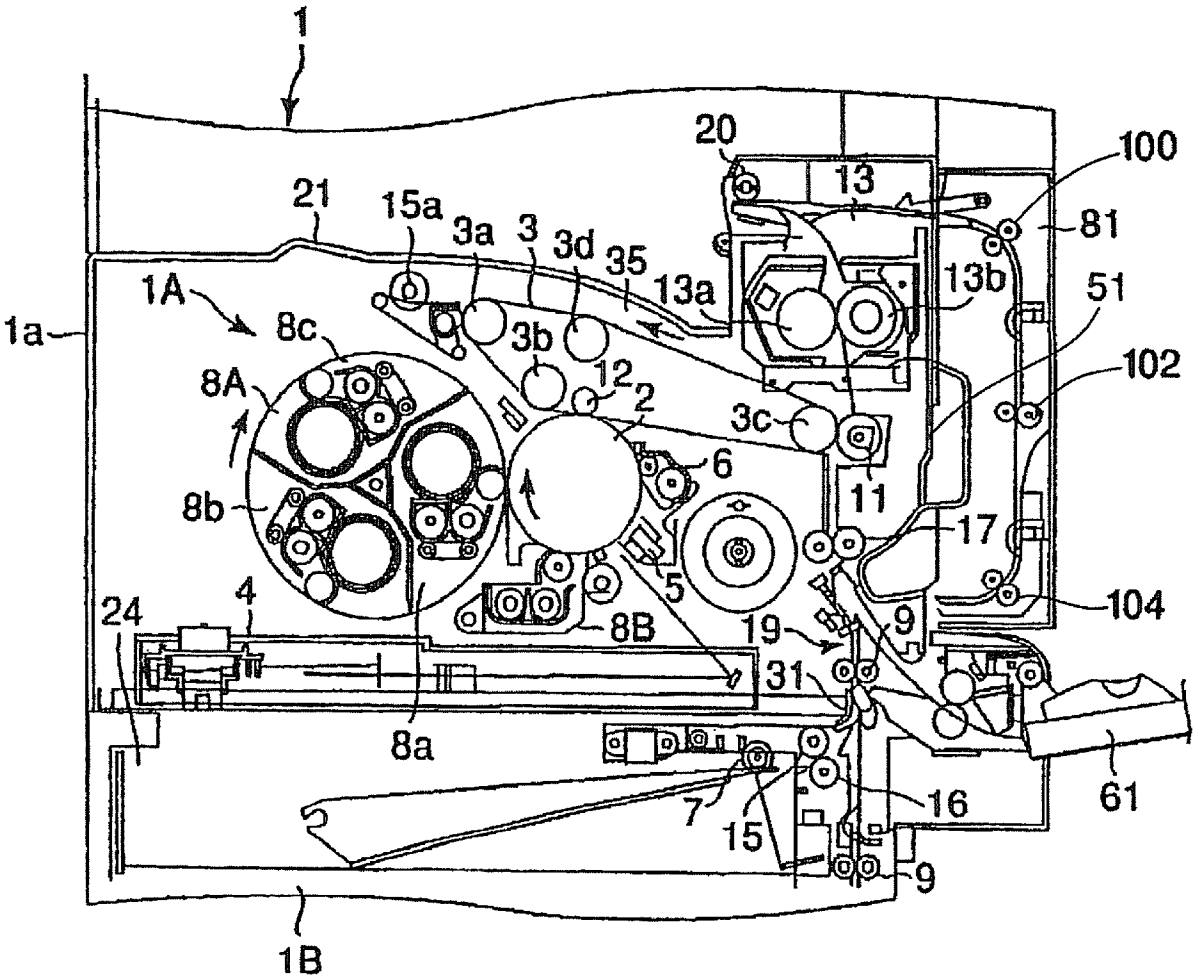
FIG. 1 is a partial sectional side view schematically showing a structure of a main part of an image forming apparatus according to an embodiment of the present invention.
Figure 2:
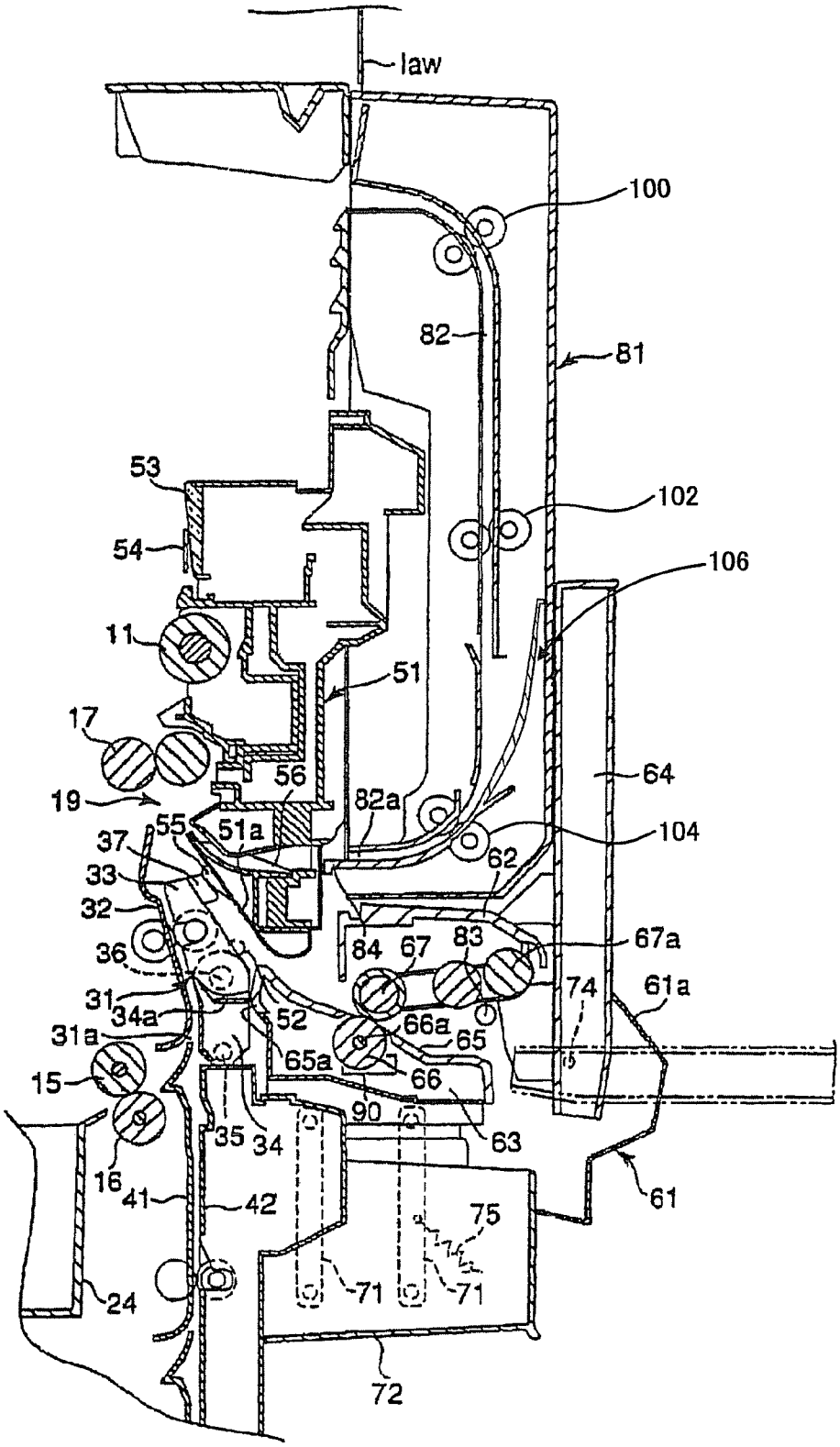
FIG. 2 is a sectional side view showing an automatic double-sided printing device and a part of details near the automatic double-sided printing device of the image forming apparatus shown in FIG. 1.

FIG. 1 is a partial sectional side view showing a structure of an image forming apparatus according to an embodiment of the present invention. FIG. 2 is a sectional side view showing an automatic double-sided printing device and a part of details near the automatic double-sided printing device of the image forming apparatus shown in FIG. 1. An overview of the image forming apparatus according to this embodiment will be explained on the basis of FIGS. 1 and 2.

An image forming unit 1A is built in an upper part of an apparatus main body 1*a* included in the image forming apparatus (e.g., an electrophotographic copying machine) shown in FIG. 1. A paper feeding unit 1B having plural paper feeding cassettes 24 is provided in a lower part of the apparatus main body 1*a*.

A photoconductive drum 2 as an image bearing member is rotatably provided in the apparatus main body 1*a*. Around the photoconductive drum 2, a charging unit 5 that charges the surface of the photoconductive drum 2 to a predetermined potential, a developing device 8B for monochrome that develops an electrostatic latent image, a rotary developing device 8A for color, an intermediate transfer belt 3 onto which a developing agent image is temporarily transferred, and a cleaner 6 that removes a residual toner on the photoconductive drum 2 are disposed along a rotating direction of the photoconductive drum 2.

The rotary developing device 8A for color has a first developing unit 8*a* that supplies a yellow toner, a second developing unit 8*b* that supplies a cyan toner, and a third developing unit 8*c* that supplies a magenta toner.

The intermediate transfer belt 3 is laid over among first to fourth rollers 3*a* to 3*d* at a predetermined tension and pressed against the photoconductive drum 2 by a first transfer roller 12. A cleaner 15*a* that cleans the intermediate transfer belt 3 is set in contact with a section of the intermediate transfer belt 3 wound around the first roller 3*a*.

An exposing device 4 that forms an electrostatic latent image on the photoconductive drum 2 is provided below the developing devices 8A and 8B.

The paper feeding unit 1B housing the paper feeding cassette 24 is provided below the exposing device 4. A pickup roller 7 that extracts sheets is provided in the paper feeding cassette 24. The sheets extracted by the pickup roller 7 are separated and delivered one by one by a paper feeding roller 15 and a separating roller 16 and conveyed along a conveying path 19.

The conveying path 19 is provided near one sidewall law (see FIG. 2) of the apparatus main body 1*a* to extend in a vertical direction along this one sidewall law. The one sidewall law has an opening for exposing the conveying path 19 and performing jam treatment.

In the conveying path 19, a sheet guide pair 31, a conveying roller pair 9, a registration roller pair 17, and a secondary transfer roller 11 described later are sequentially disposed along a conveying direction of a sheet. The registration roller pair 17 temporarily stops a sheet conveyed thereto, corrects a tilt of the sheet with respect to the conveying direction, and causes a leading end of the sheet and a leading end of a toner image on the intermediate transfer belt 3 to coincide with each other.

A fixing device (fixing means) 13 that fixes the toner image transferred onto the sheet is disposed on a downstream side in the sheet conveying direction of the secondary transfer roller 11. The fixing device 13 includes a heating roller 13*a* and a pressure roller 13*b*.

A paper discharge roller pair 20 that discharges the sheet to the outside of the apparatus main body 1*a* is provided on a downstream side in the sheet conveying direction of the fixing device 13. A discharge tray 21 that receives the sheet discharged is provided on a carrying-out side of the paper discharge roller pair 20.

A printing operation of the electrophotographic copying machine 1 will be explained in the structure of the image forming unit 1A described above.

First, an original is set in a not-shown original conveying unit and a copy button of a not-shown operation panel is turned on. Consequently, the original is conveyed and information on the original is optically read by a reading device (not shown). In this case, the surface of the photoconductive drum 2 is uniformly charged by the charging unit 5. Information light corresponding to read information is irradiated on the charged photoconductive drum 2 by the exposing device 4 and an electrostatic latent image is formed.

This electrostatic latent image is sent to the developing device 8B or the developing device 8A according to the rotation of the photoconductive drum 2. Subsequently, a toner of black is supplied from the developing device 8B or respective toners of cyan, magenta, and yellow are supplied from the developing device 8A and the electrostatic latent image is developed. A developed toner image is sent onto the intermediate transfer belt 3 according to the rotation of the photoconductive drum 2 and primarily transferred by the primary transfer roller 12. After this transfer, the photoconductive drum 2 is subjected to optical charge removal by a charge removing device (not shown). The toner remaining on the photoconductive drum 2 is cleaned by the cleaner 6.

On the other hand, a sheet supplied from the paper feeding cassette 24 through the conveying path 19 is sent into a space between the intermediate transfer belt 3 and the secondary transfer roller 11 to coincide with timing of the operation described above. The toner image on the intermediate transfer belt 3 is secondarily transferred onto this sheet. After the transfer, the sheet is peeled off from the intermediate transfer belt 3 and sent to the fixing device 13. The toner image is heated and pressed to be fixed by the fixing device 13. After this fixing, the sheet is discharged to the outside via the paper discharge roller pair 20 and placed on the discharge tray 21.

Returning to the explanation of the structure, as shown in FIG. 2, the sheet guide pair 31 included in the conveying path 19 has a fixed sheet guide 32 and a pair of upper and lower movable sheet guides 33 and 34. An entrance 31*a* formed at a lower end of the sheet guide pair 31 is located on a sheet carrying-out side of a roller pair including the paper feeding roller 15 and the separating roller 16 and set near this roller pair. The fixed sheet guide 32 is made of a guide plate.

A movable sheet guide 34 in a lower position is attached to the apparatus main body 1*a* to be rotatable with a lower end thereof as a fulcrum. Reference numeral 35 in FIG. 2 denotes a pivot that forms the fulcrum of the movable sheet guide 34. The movable sheet guide 34 is disposed to be opposed to a lower part of the fixed sheet guide 32.

A lower end of the movable sheet guide 33 in an upper position and an upper end of the movable sheet guide 34 are coupled by a pivot 36. The movable sheet guide 33 is capable of freely rotating with respect to the movable sheet guide 34 with this pivot 36 as a fulcrum. The movable sheet guide 33 is disposed to be opposed to an upper part of the fixed sheet guide 32. One side of the movable sheet guide 33 opposed to the fixed sheet guide 32 forms a first sheet guide surface that guides a sheet from the paper feeding unit 1B. The other side of the movable sheet guide 33 located on an opposite side of this one side forms a second sheet guide surface that guides a manually fed sheet. An engaging protrusion 37 for interlocking is provided on the second sheet guide surface in a position that does not prevent the conveyance of the manually fed sheet. The engaging protrusion 37 is located above the pivot 36.

The pair of upper and lower movable sheet guides 33 and 34 freely incline clockwise in FIG. 2 because of a weight balance thereof. In other words, the sheet guide pair 31 is made to freely open.

Reference numerals 41 and 42 in FIG. 2 denote sheet guides for fixing provided to be opposed to each other and extend in the vertical direction in the paper feeding unit 1B. An upper end of an intra-paper-feeding-unit conveying path formed in these sheet guides 41 and 42 communicates with the entrance 31*a* of the sheet guide pair 31. Therefore, a sheet from the paper feeding cassette 24 that is lifted through this conveying path is conveyed into the paper guide pair 31.

An open and close cover 51 that opens and closes the opening of the one sidewall law is provided in the one sidewall law of the apparatus main body 1*a*. An automatic double-sided printing device (automatic double-sided printing means) 81 (ADU) is arranged in the one sidewall law to be positioned outside the open and close cover 51 to cover the open and close cover 51. A retracting mechanism 106 according to the embodiment of the present invention is provided in this automatic double-sided printing device 81. The retracting mechanism 106 is schematically shown in FIG. 2. Details of the retracting mechanism 106 will be explained with reference to FIG. 3 and the subsequent figures (in a first embodiment).

In the one sidewall law of the apparatus main body la, a manual paper feeding device 61 (SFB) is provided adjacent to the automatic double-sided printing device 81 below the automatic double-sided printing device 81.

The open and close cover 51 is attached to be rotatable from a closed position shown in FIG. 2 to an open position not shown in the figure with a lower end thereof as a fulcrum. Reference numeral 52 in FIG. 2 indicates a pivot that forms the fulcrum of the open and close cover 51. The pivot 52 is located above the pivots 35 and 36. A magnet 53 is attached to an upper end of this open and close cover 51. The open and close cover 51 is held in a position for closing the opening of the one sidewall law by magnetic attraction between this magnet 53 and an iron piece 54 provided in the apparatus main body 1*a*. It goes without saying that the open and close cover 51 in the closed position is opened by manual operation.

The secondary transfer roller 11 is supported in an upper part of this open and close cover 51. The open and close cover 51 has a sheet guide 51*a* in a lower part thereof. This sheet guide 51*a* is arranged to be close to the second sheet guide surface of the movable sheet guide 33 when the open and close cover 51 is arranged in the closed position. An engaging protrusion 55 for interlocking is provided in the sheet guide 51*a* at a position that is above the pivot 52 and does not prevent the conveyance of a manually fed sheet. This engaging protrusion 55 is capable of coming into contact with and separating from the engaging protrusion 37. That is, the engaging protrusion 55 is separated from the engaging protrusion 37 in a state in which the open and close cover 51 is arranged in the open position. Conversely, as the open and close cover 51 is rotated from the open position to the closed position, the engaging protrusion 55 comes into contact with the engaging protrusion 37. After this contact, the engaging protrusion 55 maintains a contact state and rotates the movable sheet guides 33 and 34 in a direction for coming into contact with the fixed sheet guide 32.

The open and close cover 51 has a sheet passage (a conveying path) 56 in a lower part thereof. This sheet passage 56 guides a sheet to be subjected to double-sided printing, which is guided by the automatic double-sided printing device 81, to the registration roller pair 17.

The manual paper feeding device 61 includes a manually-fed-sheet lead-in unit 62 in an upper part, a manually-fed-sheet lead-in unit 63 in a lower part, and a manual feed tray 64, each attached to an apparatus frame 61*a*. The manually-fed-sheet lead-in units 62 and 63 forming a pair vertically are provided on opening sides of the movable sheet guides 33 and 34 in order to guide a manually fed sheet placed on the manual feed tray 64 to the middle of the conveying path 19. The manually-fed-sheet lead-in unit 63 has an oblique lead-in guide wall 65 that guides the manually fed sheet. A paper feeding roller 67 and an extraction roller 67*a* as delivery units are attached to the manually-fed-sheet lead-in unit 62 in the upper part. The manually fed sheet from the manual feed tray 64 can be delivered to the image forming unit 1A through the conveying path 19 by the paper feeding roller 67 and the extraction roller 67*a*. A separating roller 66 as a separating unit is attached to the manually-fed-sheet lead-in unit 63 to be exposed from a middle portion of the lead-in guide wall 65.

This separating roller 66 rotates in contact with the paper feeding roller 67. The separating roller 67 is in press contact with the paper feeding roller 67. A not-shown torque limiter is fit in the separating roller 66. When plural manually fed sheets are extracted by the extraction roller 67*a* at a time, one sheet at the top is delivered by the paper feeding roller 67. However, the remaining manually fed sheets are not delivered because the rotation of the separating roller 66 is stopped by a load from the torque limiter. In other words, the manually fed sheets are separated and fed one by one by the separating roller 66.

The manually-fed-sheet lead-in units 62 and 63 are provided to be movable from a set position where it is possible to manually feed paper to the conveying path 19 shown in FIG. 2 to a point in a lateral direction away from the side of the apparatus main body 1*a*. Specifically, the manually-fed-sheet lead-in units 62 and 63 are provided to be reciprocatingly movable in a horizontal direction from the set position to a retracted position deviating from a movable area of the movable sheet guides 33 and 34 in the case of jam treatment. In a state in which the manually-fed-sheet lead-in units 62 and 63 are arranged in the set position, an inclined upper end of the lead-in guide wall 65 is arranged at a lower end of a passage between the second sheet guide surface of the movable sheet guide 33 and the sheet guide 51*a*. This makes it possible to guide the manually fed sheet, which is guided by the lead-in guide wall 65, to the conveying path 19 through the passage.

A pressing section 65*a* that comes into contact with and separates from the movable sheet guide 34 is provided in the manually-fed-sheet lead-in unit 63. This pressing section 65*a* is formed of, for example, a portion bent downward from an inclined upper end portion of the lead-in guide wall 65. When the manually-fed-sheet lead-in units 62 and 63 are arranged in the set position, the pressing section 65*a* is pressed by a receiving section 34*a* of the movable sheet guide 34 and keeps the sheet guide pair 31 in the closed state. The pressing section 65*a* separates from the receiving section 34*a* and allows the sheet guide pair 31 to be opened when the manually-fed-paper lead-in units 62 and 63 are arranged in the retracted position.

In order to reciprocatingly move these lead-in units 62 and 63 integrally, for example, four links 71 constituting a parallel link mechanism are provided in the manually-fed-sheet lead-in units 62 and 63. Two of the links 71 are provided on each of both sides in a width direction of the manual paper feeding device 61. The respective links 71 are pivotally attached to the manually-fed-sheet lead-in unit 63 at upper ends thereof and pivotally attached to a bracket 72 attached to the one sidewall law at lower ends thereof.

The manual feed tray 64 is provided to be rotatable with a pivot 74 as a fulcrum from a position for use in which the manual feed tray 64 is horizontal to a position for nonuse in which the manual feed tray 64 is vertical. This rotation is manually performed. The manual feed tray 64 arranged in the position for use is arranged continuously to an inclined lower end of the manually-fed-sheet lead-in unit 63 below the manual feed tray 64. Therefore, the manually fed sheet placed on the manual feed tray 64 can be fed.

The manual paper feeding device 61 having the above-mentioned structure is always urged to the retracted position by an urging member. A coil spring 75 (shown in only FIG. 2) is used as the urging member. For example, this coil spring 75 is connected to the middle of the link 71 at one end thereof and connected to the bracket 72, which supports the link 71, at the other end to be kept in a compressed state to thereby urge the manual paper feeding device 61 to the retracted position with an elastic repulsion thereof.

The automatic double-sided printing device 81 has, for example, a flat external shape. A conveying path 82 for reversing a sheet to be subjected to double-sided printing and conveying the sheet to the image forming unit 1A is formed in the automatic double-sided printing device 81. Not-shown rotation levers protrude from both sides in a width direction at the lower end of this automatic double-sided printing device 81, respectively. Lower ends of these rotation levers are rotatably supported by the apparatus main body la. Consequently, the automatic double-sided printing device 81 is rotatably supported by the apparatus main body 1*a* with the lower end as a fulcrum and, therefore, attached to the side of the apparatus main body 1*a* to be capable of opening and closing. Reference numeral 83 in FIG. 2 denotes a pivot that forms the fulcrum of the automatic double-sided printing device 81. In other words, the automatic double-sided printing device 81 can rotate from the closed position where the automatic double-sided printing device 81 is attached to and held on the one sidewall law as shown in FIG. 2 to the open position. This rotation is manually performed. When the automatic double-sided printing device 81 is arranged in the closed position, an exit 82*a* of the conveying path 82 communicates with the sheet passage 56 of the open and close cover 51.

Near the exit 82*a* of the automatic double-sided printing device 81, an interlocking protrusion 84 that projects further forward than the exit 82*a* is formed. When the automatic double-sided printing device 81 is rotated from the open position to the closed position, this interlocking protrusion 84 hits the open and close cover 51 from an outer surface side thereof to close the open and close cover 51.

A not-shown interlocking member formed in a hook shape is attached to the rotation levers of the automatic double-sided printing device 81. This interlocking member can be engaged in and removed from a not-shown interlocking pin provided in the manually-fed-sheet lead-in unit 62 in the upper part according to the rotation of the automatic double-sided printing device 81. With this engaging and removing structure, in a state in which the automatic double-sided printing device 81 is arranged in the closed position shown in FIG. 2, the interlocking member is engaged in a state in which the interconnecting pin is fit in a not-shown recess of the interlocking member. With this engagement, the manual paper feeding device 61 is held in the set position resisting the urging force of the coil spring 75. In a state in which the automatic double-sided printing device 81 is arranged in the open state, the interlocking member comes off the interlocking pin and, according to the coming-off of the interlocking member, the manual paper feeding device 61 is pushed out to the open position by the urging force of the coil spring 75. In other words, when the automatic double-sided printing device 81 is operated to open with the interlocking member, the interlocking pin, and the coil spring 75 as manual moving means, the manual paper feeding device 61 is moved horizontally in a direction away from the side (the set position) of the apparatus main body 1*a* (to the open position) in association with the open operation. With the structure for rotation support of the automatic double-sided printing device 81, a portion (an opened portion) between the side of the apparatus main body 1*a* and the manual paper feeding device 61, which separates from the apparatus main body 1*a* is exposed to the outside.

In the manual-feed lead-in unit 63 in the lower part, a press-contact releasing mechanism 90 as press-contact releasing means for releasing press contact of the separating roller 66 and the paper feeding roller 67 is provided as shown in FIG. 2. The press-contact releasing mechanism 90 has an urging mechanism unit as urging means for urging the separating roller 66 to the paper feeding roller 67 at the normal time and a releasing mechanism unit as releasing means that releases urging to the paper feeding roller 67 of the separating roller 66 when the automatic double-sided printing device 81 is opened.

In the urging mechanism unit, the separating roller 66 movable in an upward direction for approaching the paper feeding roller 67 and a downward direction for separating from the paper feeding roller 67 is used and a structure for applying a press contact force to the shaft sections 66*a* for support protruding from both ends of the separating roller 66, respectively, is used.

In the releasing mechanism unit, a structure in which a pusher provided below the rotation lever on one side of the automatic double-sided printing device 81 and an urging member for pressure release, for example, a tension coil spring are combined is used. When the automatic double-sided printing device 81 is opened, the separating roller falls in the downward direction because of an own weight of the separating roller and separates from the paper feeding roller 67. The press contact of the separating roller 66 and the paper feeding roller 67 is released in association with the opening operation of this automatic double-sided printing device 81 by this separating operation of the separating roller 66.

In the electrophotographic copying machine 1 in which such automatic double-sided printing device 81 and manual paper feeding device 61 are assembled, in the normal state, as shown in FIG. 2, the sheet guide pair 31 is closed and the open and close cover 51 and the automatic double-sided printing device 81 are arranged in the closed positions, respectively. Moreover, the manual paper feeding device 61 is arranged in the set position and the manual feed tray 64 thereof is substantially vertically provided to overlap a lower outer surface of the automatic double-sided printing device 81.

In this normal state, the sheets in the paper feeding cassette 24 of the paper feeding unit 1B can be fed to the image forming unit 1A to print the sheets. When double-sided printing is designated in this printing, a sheet applied with printing on one side is switched back by the paper discharge roller pair 20, passes through the conveying path 82 of the automatic double-sided printing device 81, and is fed to the image forming unit 1A through the conveying path 19 again. Consequently, double-sided printing is performed.

When manual paper feeding is necessary, after the manual feed tray 64 is inclined to take a horizontal posture as indicated by an alternate long and two short dashes line in FIG. 2, a manually fed sheet P is placed and set on this tray 64. Consequently, the manually fed sheet P is fed to the image forming unit 1A through the conveying path 19 and printing is applied to a paper surface of the sheet.

First Embodiment

Figure 3:
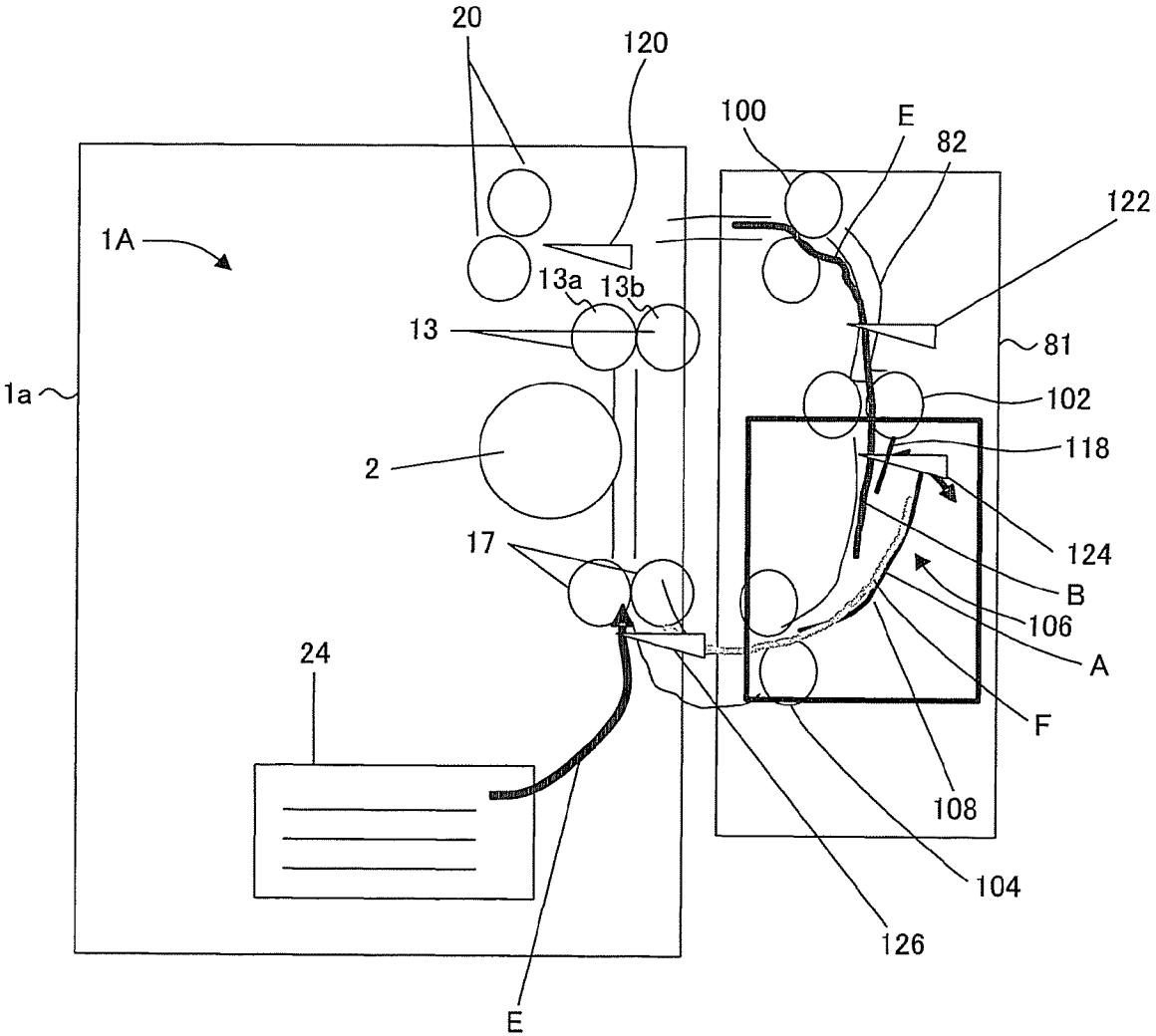
FIG. 3 is a schematic diagram of an image forming apparatus according to a first embodiment.
Figure 4:
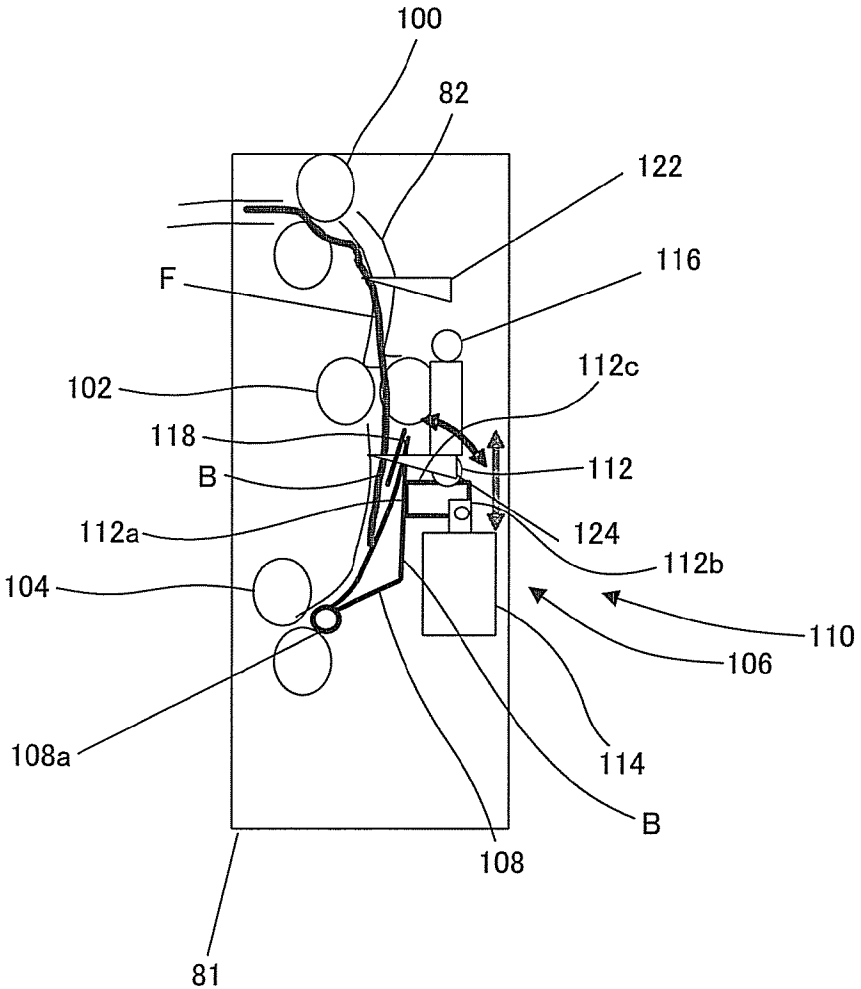
FIG. 4 is a diagram of an automatic double-sided printing device of the image forming apparatus according to the first embodiment.

The section of the automatic double-sided printing device 81 of the image forming apparatus explained above will be described more in detail. FIG. 3 is a schematic diagram of an image forming apparatus according to a first embodiment. FIG. 4 is a diagram of the automatic double-sided printing device 81 of the image forming apparatus according to the first embodiment.

In FIG. 3, a guide driving device 110 described later, which is a detailed structure in the automatic double-sided printing device (the automatic double-sided printing means) 81 is not shown. However, it is assumed that the guide driving device 110 same as that shown in FIG. 4 is provided.

As shown in FIG. 4, in the conveying path 82 of the automatic double-sided printing device 81, a first conveying roller 100, a second conveying roller (a conveying roller) 102, and a third conveying roller 104 are respectively provided in three places provided at predetermined intervals in the conveying direction. A retracting mechanism (retracting means) 106 is provided in a conveying path section formed in a vertical direction between the second conveying roller 102 and the third conveying roller 104.

The retracting mechanism 106 is provided for the purpose of stopping a sheet F, which is stopped to be conveyed in the conveying path 82, in a position away from the fixing device (the fixing means) 13 to retract the sheet F from heat of the fixing device 13 shown in FIG. 3.

Specifically, a trailing end side of a preceding sheet F conveyed earlier in the conveying path 82 is supported in a first position A shown in FIG. 3 and a leading end side of a following sheet E conveyed to follow the preceding sheet F in the conveying path 82 is supported (suspended) in a second position B where the following sheet E is not in contact with the preceding sheet F in a position where the leading end side of the following sheet E overlaps the trailing end side of the preceding sheet F in the conveying direction.

A specific structure of the retracting mechanism 106 includes a first guide (first guide means) 108 that guides the leading end side of the preceding sheet F in a conveying path direction (a downstream direction) and supports the trailing end side of the preceding sheet F in the first position A and a second conveying roller (conveying means) 102 that supports the following sheet E to support the leading end side of the following sheet E in the second position B.

The first guide 108 is supported to freely rotate (to be swingable) with a downstream side end in the conveying direction thereof as a rotation center 108*a*. The first guide 108 includes a guide driving device 110 for moving the first guide 108 between the first position A and the second position B.

The guide driving device (the guide driving means) 110 includes a link mechanism 112 and a solenoid 114 serving as power for the link mechanism 112. In the link mechanism 112, one side 112*a* of a quadric link is coupled to the first guide 108, a crank node 112*b* in a lower part of a side opposed to this one side 112*a* is coupled to the solenoid 114 that moves the crank node 112*b* up and down, and an upper side 112*c* is coupled to an urging spring 116.

The urging spring 116 urges the link mechanism 112 in a direction in which the first guide 108 is always located in the second position B in a state in which the solenoid 114 is lifted. When the solenoid 114 is lowered, one side 112*a* of the link mechanism 112 moves the first guide 108 from the second position B to the first position A.

The link mechanism 112 is not limited to the above-mentioned shape. For example, it is also possible to couple one ends of two shafts with a link or a long hole, couple the other end of one shaft to the first guide 108 and couple the other end of the other shaft to the solenoid 114, couple one shaft to the urging spring 116, and urge the link mechanism 112 in a direction in which the first guide 108 is always located in the second position B. In this case, it is possible to reduce an influence due to motion of the link mechanism 112 by supporting the lower ends of the solenoid 114 to freely rotate, and improve mechanical strength of the solenoid 114.

A second guide (second guide means) 118 that guides a leading end side of a sheet to the second position B is provided on an upstream side in the conveying path of the first guide 108.

As shown in FIG. 3, a first sheet detection SW (switch) 120 is provided near the paper discharge roller pair 20 of the conveying path 82 from the paper discharge roller pair 20 to the automatic double-sided printing device 81 in the apparatus main body 1*a*. A second sheet detection SW (a following-sheet detecting unit, following-sheet detecting means) 122 is provided in the conveying path 82 near an upstream side of the second conveying roller 102 of the automatic double-sided printing device 81. Moreover, a third sheet detection SW 124 is provided in the conveying path 82 near a downstream side of the second conveying roller 102. Furthermore, a registration SW 126 is provided in the conveying path 82 near an upstream side of the registration roller pair 17 of the automatic double-sided printing device 81.

Each of the switches 120, 122, 124, and 126 detects passage of a sheet in a position of the switch. Specifically, when a sheet passes each of the switches, the switch is turned off (or on) and detects a passing state of the sheet. The third sheet detection SW 124 and the registration SW 126 constitute a stop detecting unit for a preceding sheet (stop detecting means for a preceding sheet) that detects that the preceding sheet F is stopped on the first guide 108.

Operations of the image forming apparatus according to the first embodiment will be explained.

Figure 5:
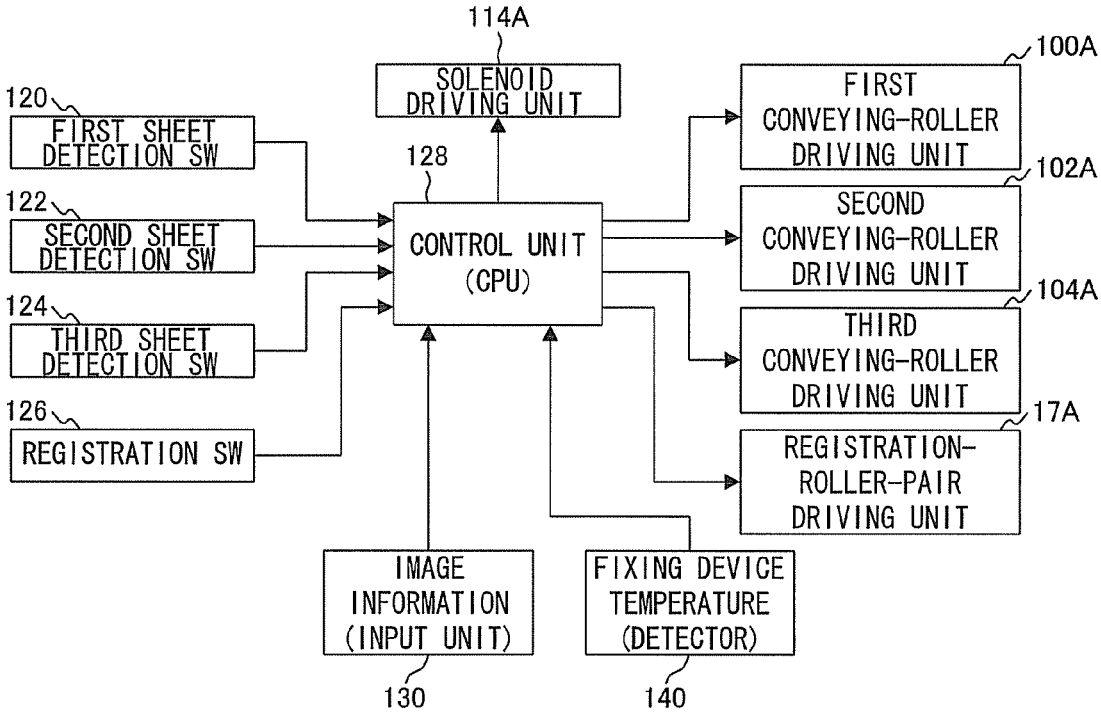
FIG. 5 is a functional block diagram for explaining the image forming apparatus according to the embodiment.

FIG. 5 is a functional block diagram for explaining the image forming apparatus according to this embodiment.

The first sheet detection switch SW 120, the second sheet detection SW 122, the third sheet detection SW 124, and the registration SW 126 are connected to a control unit 128 including a CPU. Detection results of the switches are inputted to the control unit 128. Image information from an image-information inputting unit 130 and a fixing device temperature from the fixing-device-temperature detecting device 140 are also inputted to the control unit 128. Processing of the image information in the control unit 128 takes time depending on an information processing amount of the image information. Thus, an image forming operation is temporarily stopped according to the processing amount.

When supply of a heat quantity to the heating roller 13*a* for obtaining the fixing device temperature is delayed in a fixing area in which the fixing device 13 is arranged, the image forming operation is temporarily stopped. The control unit 128 applies control for switching operation and stop of a first conveying-roller driving unit 100A, a second conveying-roller driving unit 102A, a third conveying-roller driving unit 104A, and a registration-roller-pair driving unit 17A, and a solenoid driving unit 114A to the driving units on the basis of the inputted respective pieces of information.

Figure 6:
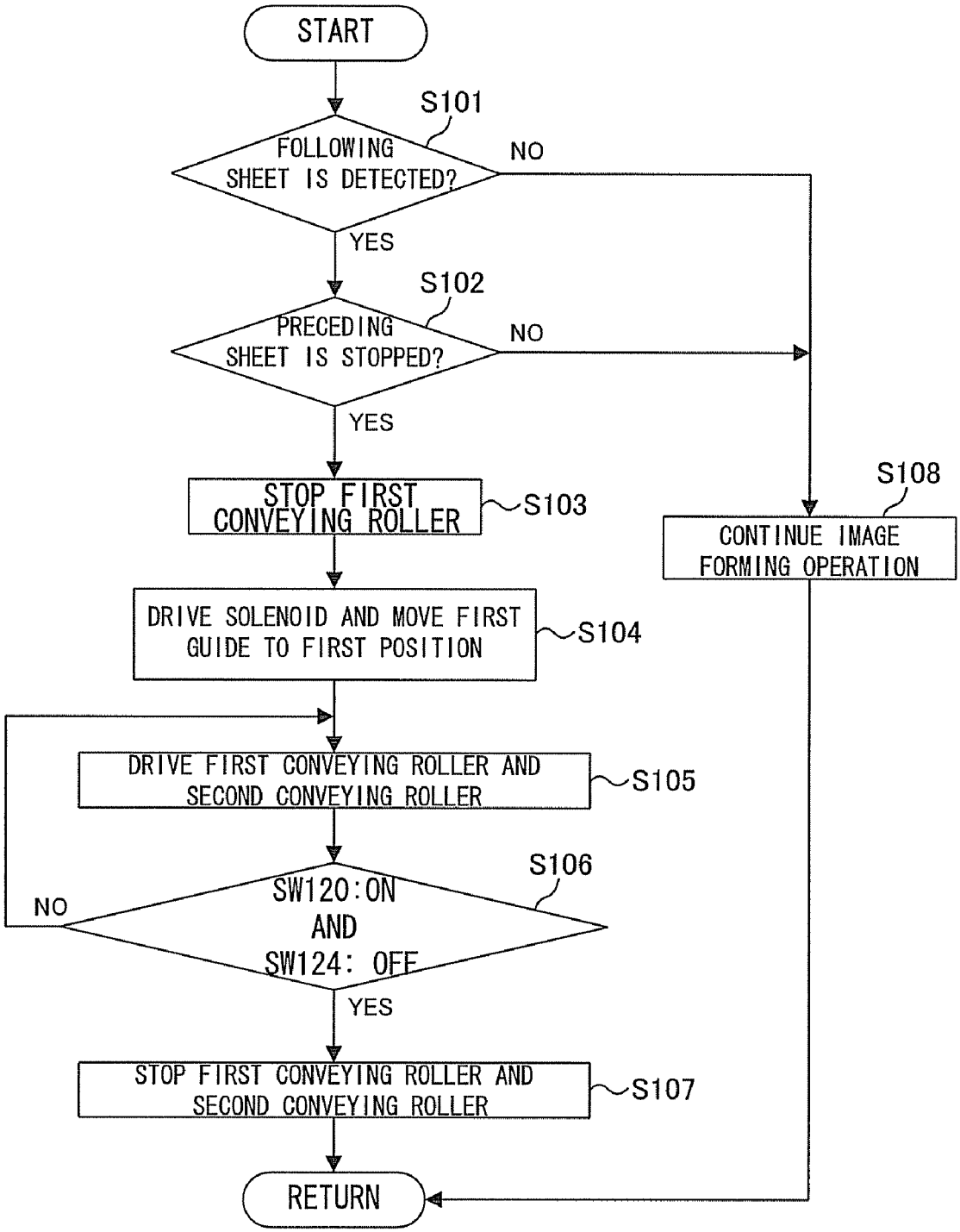
FIG. 6 is a flowchart for explaining a flow of processing in the image forming apparatus according to the first embodiment.

FIG. 6 is a flowchart for explaining a flow of processing in the image forming apparatus according to the first embodiment. In the following explanation, control of the image forming apparatus according to the first embodiment will be explained in accordance with the flowchart shown in FIG. 6.

First, when the leading end of the following sheet E is detected by the second sheet detection SW 122 (step S101 (a sheet carrying-in step), Y) and when it is decided that the preceding sheet F is stopped in a position of the first guide 108 (step S102 (a preceding sheet detecting step, Y), the control unit 128 stops the first conveying roller 100 (step S103) to stop the conveyance of the following sheet E. The control unit 128 drives the solenoid 114 and swings the first guide 108 around the rotation center 108*a* with the link mechanism 112 to move the first guide 108 from the second position B shown in FIG. 4 to the first position A shown in FIG. 3 (step S104).

When the first guide 108 comes into a state of the position A, next, the control unit 128 drives the first conveying roller 100 and the second conveying roller 102 and conveys the following sheet E until the leading end of the following sheet E is supported by the second position B (step S105). That is, the control unit 128 decides that the trailing end of the following sheet E has moved on the conveying path to a state retracted from the fixing area (a state away from the fixing area) by deciding that the trailing end of the following sheet E passes the first detection SW 120 and the first sheet detection SW 120 is turned ON and the leading end of the following sheet E passes the third sheet detection SW 124 and the third sheet detection SW 124 is turned OFF (step S106). When it is decided that the trailing end of the following sheet E is in that state (step S106, Y), the control unit 128 stops the driving of the first conveying roller 100 and the second conveying roller 102 (step S107).

Consequently, the leading end of the following sheet E is supported in the second position B, the trailing end of the following sheet E comes into the state retracted from the fixing area, and the following sheet E is stopped. Here, steps S104 to S107 constitute a retracting step according to the present invention.

In step S101, in judging that the preceding sheet F is stopped in the position of the first guide 108, a stop time of the preceding sheet F (a waiting time for a following sheet) may be judged, on the basis of image information to be processed, according to a processing amount (a processing time) of the image information, a fixing device temperature (a heating time), and the like and, when the stop time is equal to or longer than a predetermined time, the processing for retracting the following sheet (steps S104 to S107) may be performed.

In this way, according to this embodiment, since the following sheet E is not left untouched while the trailing end of the following sheet E is located in a high-temperature area, it is possible to prevent formation of image dust. A sheet is less easily damaged. When jam or the like occurs, it is possible to continuously perform the image forming operation simply by removing paper jammed and it is possible to reduce a waste of sheets.

Second Embodiment

Figure 7:
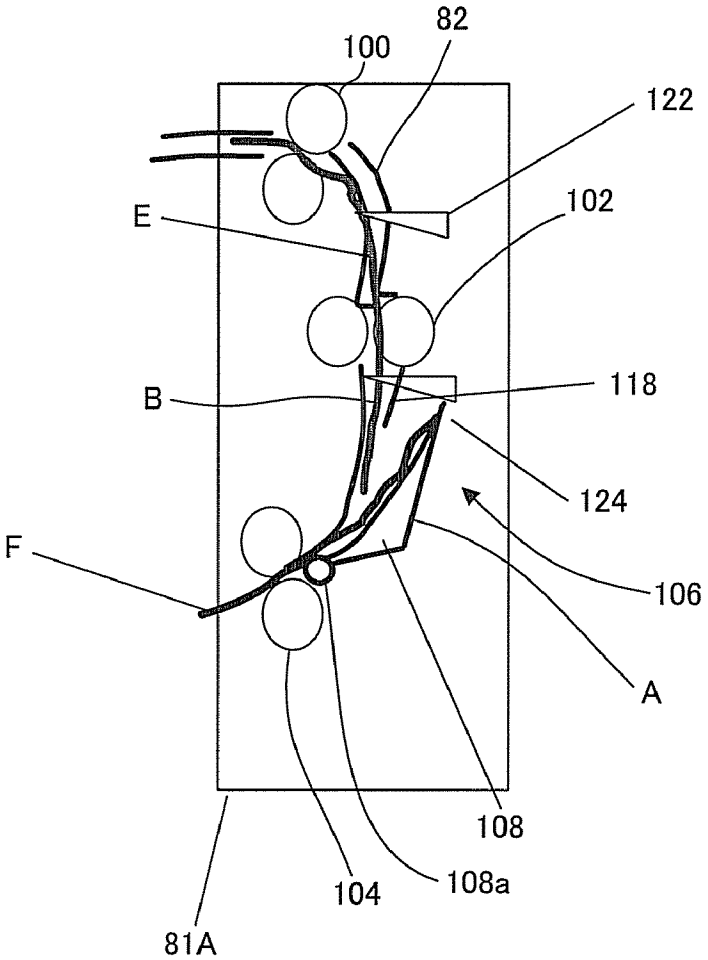
FIG. 7 is a diagram showing an image forming apparatus according to a second embodiment.

FIG. 7 is a diagram showing an automatic double-sided printing device 81A according to a second embodiment.

In the second embodiment, the guide driving device 110 in the first embodiment is omitted and the first guide 108 is formed in the opened state in the first position A in the first embodiment.

Therefore, in an operation according to the second embodiment, the processing in step S104 in FIG. 6, which is the control flow according to the first embodiment, is omitted.

According to the second embodiment, since a mechanism for moving a guide is unnecessary, a structure of the automatic double-sided printing device 81A is simplified. There is also an effect that a sheet is not damaged by driving of the guide.

In this case, the conveyance of the following sheet E by the first conveying roller 100 may be always performed to the position B (step S103 is omitted) regardless of whether a preceding sheet is stopped.

Third Embodiment

Figure 8:
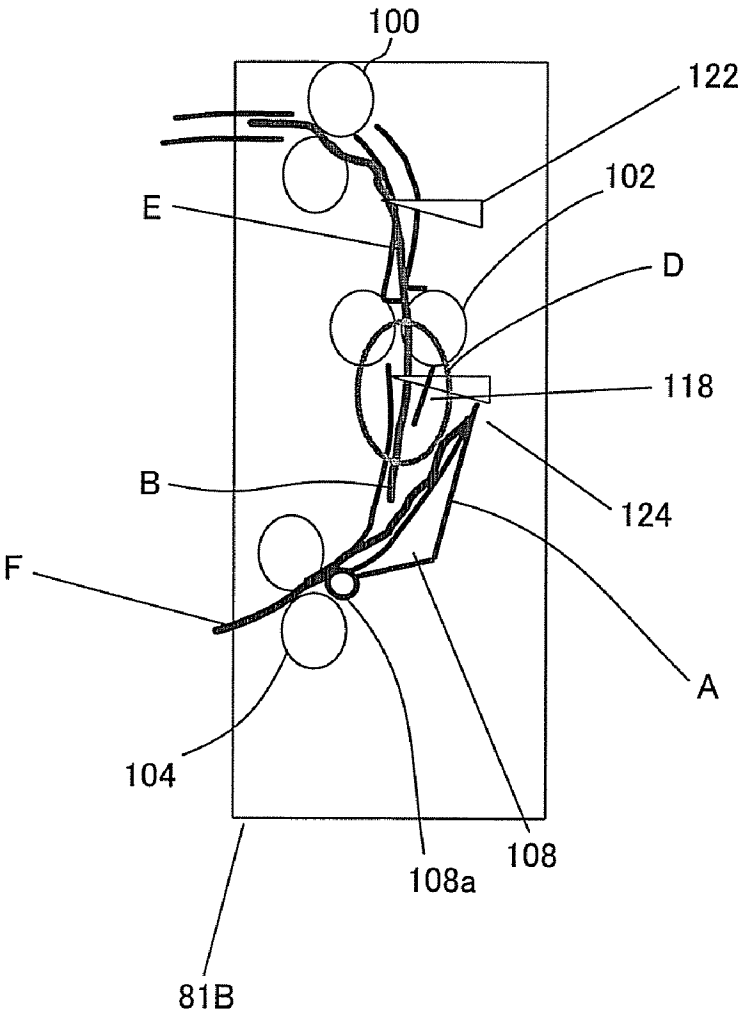
FIG. 8 is a diagram showing the image forming apparatus according to the second embodiment.

FIG. 8 is a diagram showing an automatic double-sided printing device 81B of an image forming apparatus according to a third embodiment.

This automatic double-sided printing device 81B is different from the automatic double-sided printing device according to the second embodiment in a structure of a section encircled by an ellipse D in FIG. 8 and is the same as the automatic double-sided printing device according to the second embodiment in structures of other sections. Thus, only differences will be explained.

The second guide 118 according to the third embodiment is formed of a deformable elastic member such as Mylar (registered trademark). This makes it possible to set a space of the conveying path 82 in the section of the second guide 118 as narrow as possible. Therefore, since it is possible to secure a space between the second guide 118 and the first guide 108 wide, it is possible to form an area in which the preceding sheet F can be retracted as large as possible.

The present invention has been explained in detail according to specific forms. However, it is obvious for those skilled in the art that various modifications and alterations of the embodiments are possible without departing from the spirit and the scope of the present invention.

As described above in detail, according to the present invention, it is possible to provide the image forming apparatus and the double-sided printing method for the image forming apparatus that can prevent occurrence of an image failure by providing the retracting mechanism in the conveying path of the automatic double-sided printing device to prevent occurrence of temporary stop near the high-temperature fixing device during a double-sided printing operation.

What is claimed is:

1. An image forming apparatus comprising:

an image forming unit configured to form an image on a sheet;

a fixing device that fixes the image formed by the image forming unit on the sheet;

a discharge tray that receives the sheet from the fixing device;

a discharge roller that discharges the sheet which is conveyed via a first conveying path from the fixing device to the discharge tray;

an automatic double-sided printing device that has a second conveying path which is different from the first conveying path, which receives the sheet has the image fixed thereon by the fixing device and is switched back by the discharge roller, and which reverse the sheet conveyed into the automatic double-sided printing device to feed the sheet to the image forming unit; and a retracting mechanism that stops the sheet, which is not conveyed in the second conveying path, in a position away from the fixing device to retract the sheet from heat of the fixing device, the retracting mechanism being provided in the second conveying path of the automatic double-sided printing device, the retracting mechanism that supports a trailing end side of a preceding sheet, which has been conveyed in the second conveying path, in a first position, and that supports a leading end side of a following sheet, which is conveyed to follow the preceding sheet in the second conveying path, in a second position where the following sheet does not come into contact with the preceding sheet in a position where the leading end side of the following sheet overlaps the trailing end of the preceding sheet in a conveying direction, and the retracting mechanism that includes:

a first guide that guides the leading end side of the preceding sheet in the conveying direction and supports the trailing end side of the preceding sheet in the first position; and a conveying roller that supports the following sheet to support the leading end side of the following sheet in the second position.

2. An image forming apparatus according to claim 1, further comprising: a stop detecting unit for the preceding sheet configured to detect that the preceding sheet is stopped in the first position; and a following-sheet detecting unit configured to detect that the leading end of the following sheet has passed a predetermined position in the second conveying path, wherein the retracting mechanism operates on the basis of detection results of the stop detecting unit and the following-sheet detecting unit.

3. An image forming apparatus according to claim 1, wherein the retracting mechanism is provided in the second conveying path formed in a vertical direction.

4. An image forming apparatus according to claim 1, wherein the first guide is movable between the first position and the second position.

5. An image forming apparatus according to claim 1, wherein a second guide that guides a leading end side of a sheet to the second position is provided on an upstream side in the conveying path of the first guide.

6. An image forming apparatus according to claim 4, further comprising, in order to move the first guide between the first position and the second position, a guide driving device that has a link mechanism and a solenoid.

7. An image forming apparatus comprising:

image forming means for forming an image on a sheet;

fixing means for fixing the image formed by the image forming means on the sheet;

discharge receiving means for receiving the sheet from the fixing means;

discharging means for discharging the sheet being conveyed via a first conveying path from the fixing means to the discharge receiving means;

automatic double-sided printing means that has a second conveying path which is different from the first conveying path which receives the sheet having the image fixed thereon by the fixing means and is switched back by the discharging means, and reversing the sheet conveyed to feed the sheet to the image forming means; and retracting means for stopping the sheet, which is not conveyed in the second conveying path, in a position away from the fixing means to retract the sheet from heat of the fixing means, the retracting means being provided in the second conveying path of the automatic double-sided printing means, supports a trailing end side of a preceding sheet, which has been conveyed, in a first position, and supports a leading end side of a following sheet, which is conveyed to follow the preceding sheet in the second conveying path, in a second position where the following sheet does not come into contact with the preceding sheet in a position where the leading end side of the following sheet overlaps the trailing end side of the preceding sheet in a conveying direction, and the retracting means includes:

first guide means for guiding the leading end side of the preceding sheet in the conveying direction and supporting the trailing end side of the preceding sheet in the first position; and conveying means for supporting the following sheet to support the leading end side of the following sheet in the second position.

8. An image forming apparatus according to claim 7, further comprising:

stop detecting means for the preceding sheet for detecting that the preceding sheet is stopped in the first position; and following-sheet detecting means for detecting that the leading end of the following sheet has passed a predetermined position in the second conveying path, wherein the retracting means operates on the basis of detection results of the stop detecting means and the following-sheet detecting means.

9. An image forming apparatus according to claim 7, wherein the retracting means is provided in a the second conveying path formed in a vertical direction.

10. An image forming apparatus according to claim 7, wherein the first guide means is movable between the first position and the second position.

11. An image forming apparatus according to claim 7, wherein second guide means for guiding a leading end side of a sheet to the second position is provided on an upstream side in the conveying path of the first guide means.

12. An image forming apparatus according to claim 10, further comprising, in order to move the first guide means between the first position and the second position, guide driving means that has a link mechanism and a solenoid.

13. A double-sided printing method for an image forming apparatus, comprising:

discharging a sheet being conveyed via a first conveying path from a fixing device to a discharge tray;

conveying, via the fixing device, a following sheet into an automatic double-sided printing device subsequently to a preceding sheet from an image forming unit that forms an image on a sheet;

detecting the preceding sheet stopped to be conveyed in a second conveying path of the automatic double-sided printing device; and when it is detected that the preceding sheet is not conveyed stopping the following sheet in a position away from the fixing device to retract the following sheet from heat of the fixing device, the retraction of the following sheet is performed by supporting a trailing end side of a preceding sheet, which has been conveyed in the second conveying path, in a first position and supporting a leading end side of a following sheet, which is conveyed to follow the preceding sheet in the second conveying path, in a second position where the following sheet does not come into contact with the preceding sheet in a position where the leading end side of the following sheet overlaps the trailing end of the preceding sheet in a conveying direction, in the retraction of the following sheet, the leading end side of the preceding sheet is guided in the second conveying path direction and the trailing end side of the preceding sheet is supported in the first position by a first guide and the leading end side of the following sheet is supported in the second position by the conveying roller.

14. A double-sided printing method for an image forming apparatus according to claim 13, wherein the first guide is movable between the first position and the second position.

* * * * *